United States Patent [19]

Barron

[11] 4,098,413

[45] Jul. 4, 1978

[54] BIN GATE OPERATING APPARATUS

[75] Inventor: William E. Barron, Johnstown, Pa.

[73] Assignee: Bethlehem Steel Corporation, Bethlehem, Pa.

[21] Appl. No.: 740,274

[22] Filed: Nov. 9, 1976

[51] Int. Cl.[2] ..... B65G 65/66

[52] U.S. Cl. ..... 214/17 R; 214/41 R

[58] Field of Search ..... 214/18 PH, 41, 17 R

[56] References Cited

U.S. PATENT DOCUMENTS 1,734,686 11/1929 McCollum et al. ..... 214/41

3,404,963 10/1968 Fritsche et al. ..... 214/17 CA X

*Primary Examiner*—Robert G. Sheridan

*Attorney, Agent, or Firm*—Joseph J. O'Keefe; Michael J. Delaney; Anson W. Biggs

[57] ABSTRACT

Apparatus for opening and closing the gates on a material storage bin to control the discharge of the contents therein into a receiving hopper. The apparatus is hydraulically operated and includes means to lock the receiving hopper in place in alignment with the bin gates.

4 Claims, 8 Drawing Figures

FIG. 2
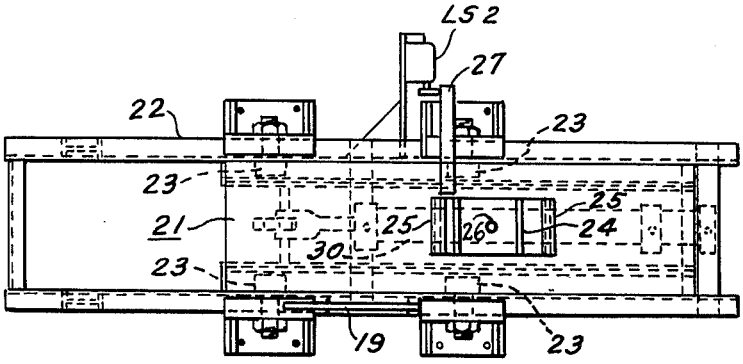
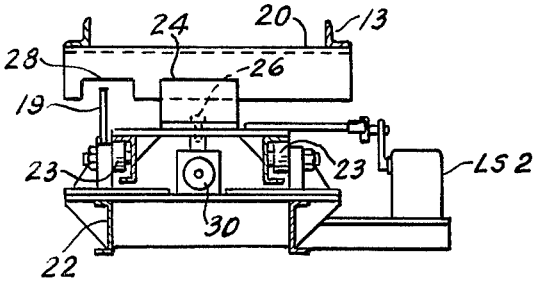
FIG. 3
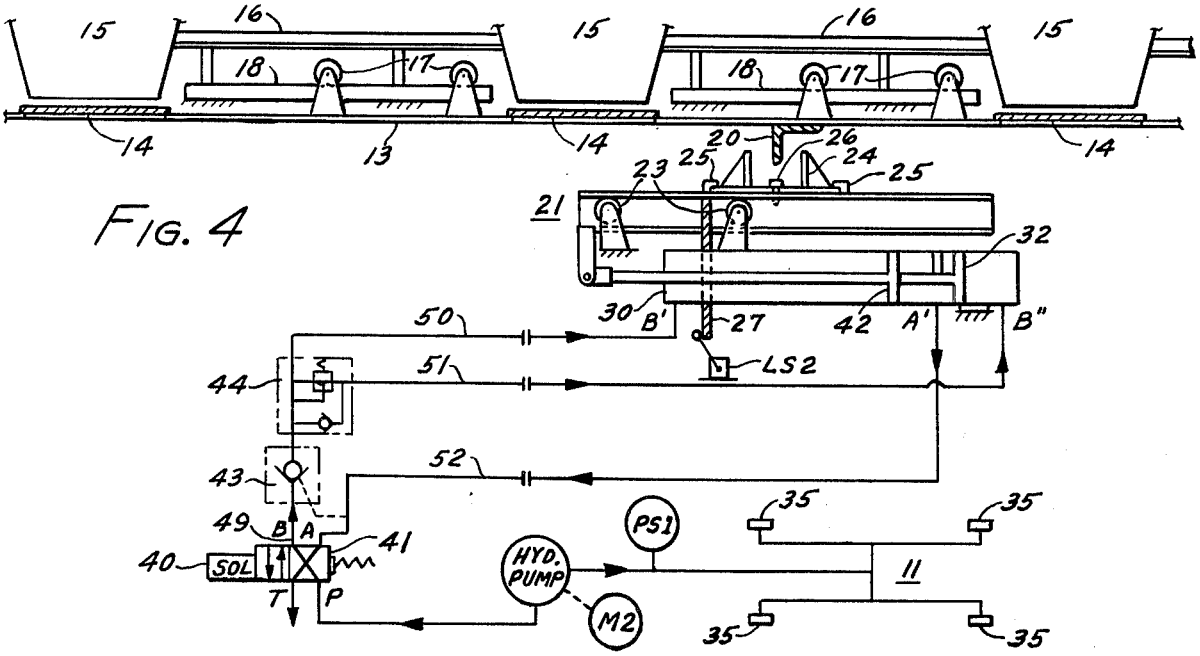
FIG. 4

BIN GATE OPERATING APPARATUS

BACKGROUND OF THE INVENTION

This invention relates generally to the transfer of materials from a storage bin to a receiving hopper and more particularly to the apparatus for controlling the discharge of the materials from the storage bin.

In the production of coke for use in steelmaking coal is stored in bins mounted above the coke oven battery. A larry car traveling on rails on top of the coke oven battery and having receiving hoppers mounted on the larry car carries a charge of coal to the oven to be charged and then returns to a position under the coal storage bins to receive the next charge.

The coal bin gates over each hopper may be individually operated, driven by electric motors through gear boxes and crank arms, or the bin gates may be linked together and power operated so that all gates open simultaneously. When the larry car operator opens the gates the power to the car is shut off to prevent the car from moving out from under the open gates. The ventilating system on the larry car, dependent upon power for its operation, becomes inoperative during the periods of loading coal in the larry car hoppers. The comfort and safety of the larry car operator are thus impaired. Recent regulations of the OSHA require the continued operation of the ventilating system.

The system which links the bin gates together includes the use of counterweights to close the gates. If the car drifts from under the coal storage bins considerable spillage occurs before the counterweights operate to close the gates. The spillage necessitates extra time and manpower to clean up so that normal operations can be resumed. By eliminating the counterweight the force needed to open the gates may be reduced by one half, thereby reducing the size of the hydraulic cylinder required.

SUMMARY OF THE INVENTION

It is an object of this invention to provide apparatus to control the flow of material from a storage bin to a receiving hopper which eliminates spillage.

It is a further object of this invention to provide apparatus which locks the receiving hoppers in position beneath the storage bins.

It is another object of this invention to provide apparatus which permits the operation of the bin gates and maintains the larry car ventilating equipment operative.

It is a still further object to provide apparatus for operating the bin gates which eliminates the counterweights.

The instant invention accomplishes these objects by providing apparatus including a hydraulic cylinder which is adapted to open and close the bin gate as desired and having means to lock the larry car in position under the bins while material is being discharged therefrom. Further safety means is also provided to prevent accidental movement of the larry car from under the storage bins.

INCORPORATION BY REFERENCE

The disclosure of U.S. Pat. No. 3,070,516 issued Dec. 25, 1962 to Wethly is hereby incorporated by reference; specifically, such disclosure as it relates to a larry car having material receiving hoppers mounted thereon and movable by means of wheels traversing along tracks on the top of a battery of coke ovens to position the material receiving hoppers in alignment with charging openings in a coke oven battery.

BRIEF DESCRIPTION OF THE DRAWINGS

FIG. 2 is a plan view of a portion of the apparatus taken on line 2—2 of FIG. 1.

FIG. 3 is a sectional view of a portion of the apparatus taken on line 3—3 of FIG. 1.

FIG. 4 is a schematic drawing of the hydraulic system showing the apparatus in the car travel position.

DESCRIPTION OF THE PREFERRED EMBODIMENT

Figure 1:
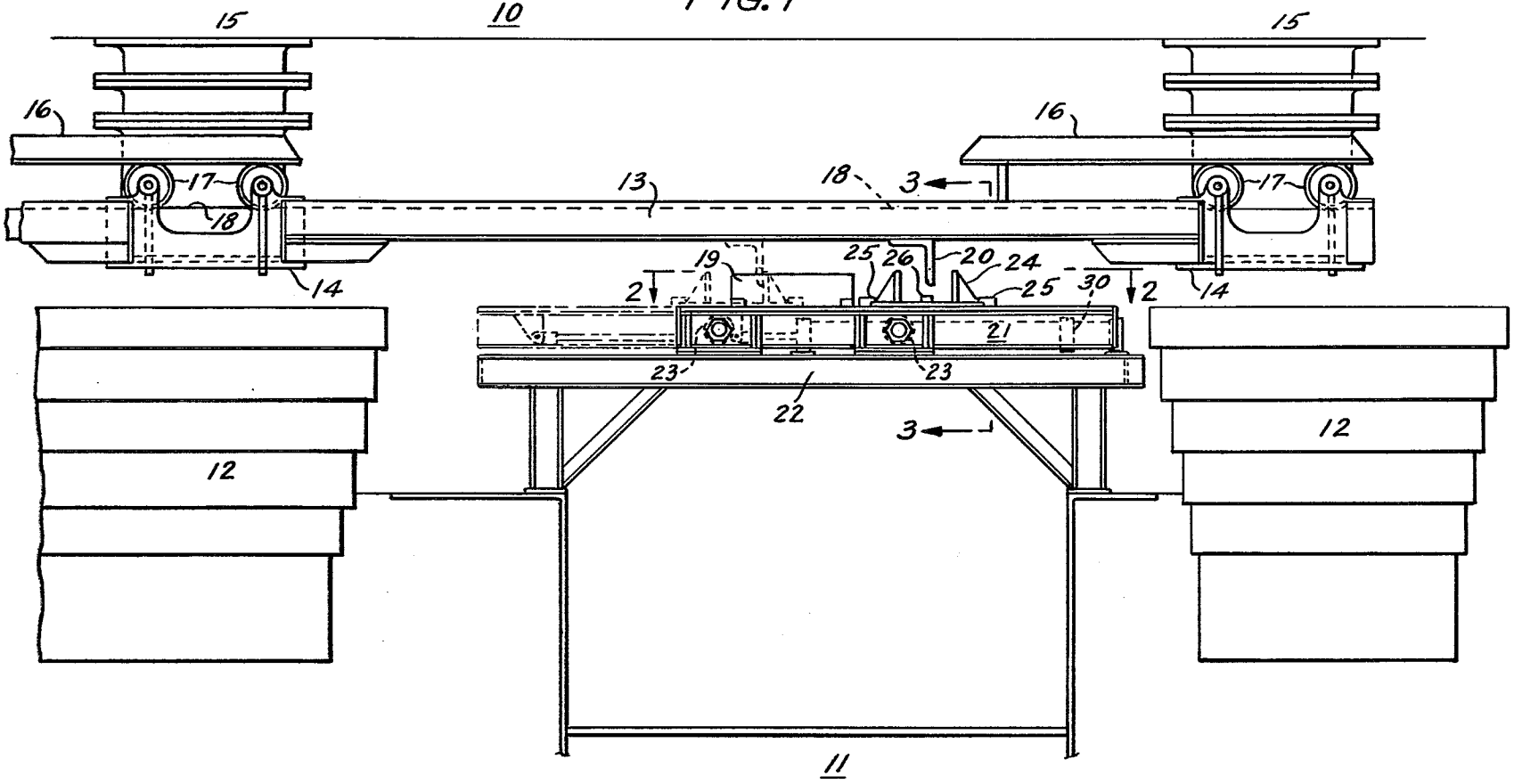
FIG. 1. is an elevation of the apparatus of the instant invention.

Referring now to the drawings and particularly to FIGS. 1 and 2, a portion of a coal storage bin 10 is seen with a larry car 11 having receiving hoppers 12 beneath the coal storage bin 10 and substantially aligned therewith. A bin gate frame 13 links the bin gates 14 of the coal storage bin 10 together. This invention is, of course, applicable to either a single bin or a plurality of bins in line. The bin gates 14 are rigidly connected to bin gate frame 13 and movably supported from the bin structure 10 by means of members 16 which are rigidly connected to the bin structure. The bin gate frame 13 is adapted to be moved back and forth a distance of about 27 inches on wheels 17 and rails 18. Gate lever 20 is rigidly fixed to the underside of bin gate frame 13 projecting beneath the frame for a purpose to be explained hereinafter.

Carriage 21 is mounted beneath bin gate frame 13 and spaced therefrom on carriage roller frame 22 which is supported on receiving hoppers 12 of larry car 11. Carriage 21 is adapted for movement on roller frame 22 to open and close the bin gates 14. Rollers 23 are removably attached to roller frame 22 to guide and support carriage 21 as it is moved back and forth within roller frame 22 in a manner to be discussed in detail hereinafter.

An upwardly projecting guiding element 24 is mounted on carriage 21 to contact the downwardly projecting gate lever 20 mounted on bin gate frame 13 and cause the bin gate frame 13 to move thereby opening or closing the bin gates 14. The guiding element 24 is mounted on carriage 21 by means of clamps 25 and shear pin 26 so that if the guiding element 24 strikes any obstruction during the travel of the larry car 11 the shear pin 26 will fail and allow guiding element 24 to slide out from clamps 25 before damage to equipment or structure occurs.

A specially designed double acting duplex hydraulic cylinder 30 is fixedly mounted on roller frame 22 with the rod end removably attached to carriage 21, thus providing means to move the carriage 21 to cause guiding element 24 to contact gate lever 20 to open and close the bin gates 14. The design of the hydraulic cylinder 30 and its advantages will be clear from the description of the operation of the apparatus hereinbelow.

Limit switch LS2 is fixedly mounted on roller frame 22 and contact lever 27 is mounted on carriage 21, the purpose of which will also become apparent from the description of the operation of the apparatus.

A safety plate 19 is removably attached to roller frame 22 to prevent accidental movement of larry car 11 from under the storage bin 10 as will be understood.

Referring to FIG. 3, a sectional view of a portion of the apparatus is seen taken on line 3—3 of FIG. 1. Downwardly projecting gate lever 20 is seen with a notch 28 to allow safety plate 19 to pass into the slotted area. This is a safety feature to prevent the accidental movement of the larry car 11 from beneath the coal storage bin 10 during discharge of coal therefrom.

The operation of the apparatus will now be discussed in detail with particular reference to FIGS. 4–8 inclusive.

A larry car 11 on which the bin gate operating apparatus is mounted is moved by electric motor M1, driven wheels 35 to position it on the coke oven battery beneath the coal storage bin 10 with the receiving hoppers 12 aligned with the bins 15 to receive a charge of coal from the bins for charging one of the ovens of the battery. The brakes on the wheels 35 of larry car 11 are applied to lock the car in position. A pressure switch PS1 responsive to the pressure in the hydraulic circuit of the larry car wheel brakes causes an electrical circuit to be closed through a relay CR1 to allow the bin gate operating apparatus to operate. If the pressure in the hydraulic circuit of the brake system falls off for any reason the pressure switch PS1 breaks the electrical circuit which causes the bin gate operating apparatus to close the bin gates.

When switch SW1 is closed the operator can move larry car 11 along the top of the coke oven battery to position the larry car 11 as desired as e.g. beneath coal storage bins 10 through means of the larry car wheel drive M1. SW1 is opened when the car is properly positioned. The brakes on the larry car wheels 35 are set as hereinbefore described and the larry car operator then initiates the operation of the bin gate operating apparatus by closing SW2 which energizes solenoid SV1 to actuate a hydraulic cylinder operated probe PR1 to make contact with an electrically charged contact plate CP1. The power fed from this plate CP1 through the probe PR1 picks up a relay CR2 which energizes solenoid valve SV2 and also starts a hydraulic pump motor M2 shown for supplying hydraulic fluid at approximately 600 psig. to the hydraulic system for operating the bin gate operating apparatus. The schematic drawing, FIG. 4, of the hydraulic system shows the apparatus in the car travel position as the larry car is positioned under the coal storage bin 15. The four-way valve 41 with ports A and B is positioned so that lines 50 and 51 are under pressure and line 52 is open to exhaust. There is of course no flow in these lines when the apparatus is in the car travel position.

The duplex hydraulic cylinder 30 is designed to have two pistons moving freely of one another within the hydraulic cylinder. Piston 42 has the longer stroke, in this case 27 inches, and piston 32 has a relatively shorter stroke of 3 inches. The cylinder is provided with three ports A′, B′ and B″ to permit flow of the hydraulic fluid into and out of the chambers of the hydraulic cylinder 30.

Figure 5:
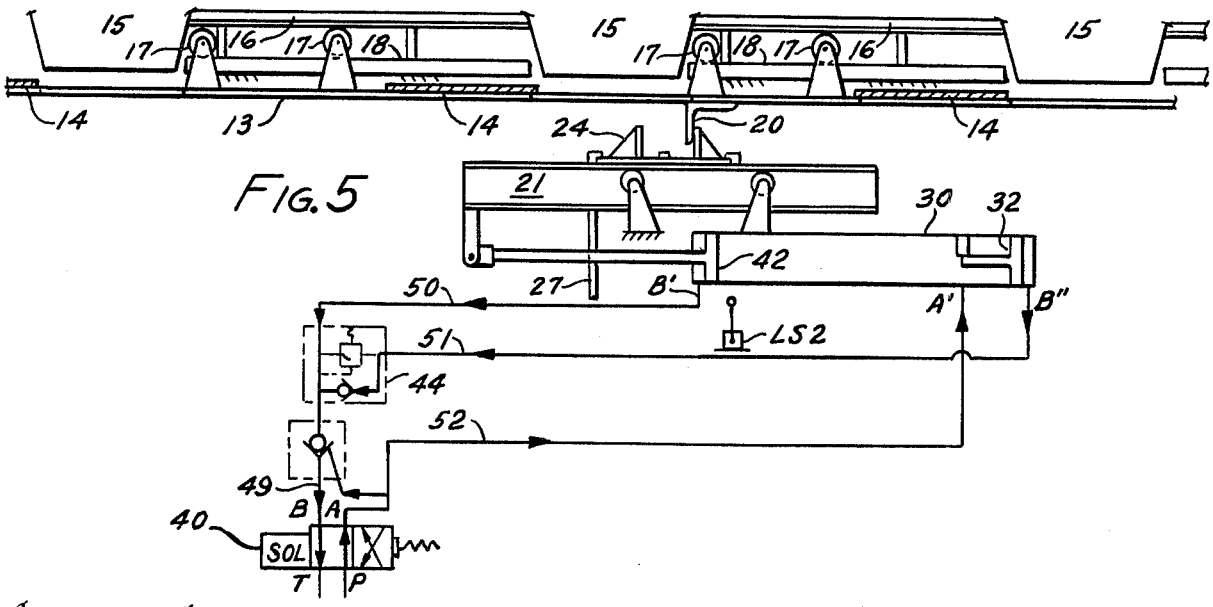
FIG. 5 is similar to FIG. 4 showing the apparatus with gates open and car in locked position.

FIG. 5 is a schematic drawing of the apparatus with the gates open and the car in locked position. The operator shifts the four-way valve 41 from the position shown in FIG. 4 by any convenient means, e.g. electrical or mechanical, as will be apparent to those skilled in the art to initiate the opening of the bin gates 14. The hydraulic pressure supplied by the hydraulic pump passes through port A of the four-way valve 41, line 52 and port A′ of the duplex cylinder 30.

Piston 42 is driven to the left and piston 32 to the right by pressure in line 52, lines 50 and 51 exhausting to a tank. As piston 42 moves the carriage 21 which is attached to the rod end thereof, the guiding element 24 after moving 3 inches contacts gate lever 20. The guiding element 24 continues to move to the left causing the bin gates 14 to open. The 27 inch stroke of piston 42 causes the gates 14 to open 24 inches. Contact lever 27 mounted on the guiding element 24 passes limit switch LS2 after carriage 21 moves about 2 inches to the left. LS2 then closes one circuit which keeps the hydraulic pump operating by means of CR3 and opens a second circuit which locks out the larry car 11 wheel drive motor as shown on the electrical control circuit, FIG. 8, and as will be understood by those skilled in the art. After carriage 21 moves 6 inches to the left a notch 28 in gate lever 20 (best seen in FIG. 3) passes over the safety plate 19 which is removably attached to stationary roller frame 22. The safety plate 19, because of its position in the notch 28 of gate lever 20, prevents the larry car 11 from drifting out from under the open gates 14 since it would hit the edge of the notch 28 in gate lever 20 should the car move.

Figure 6:
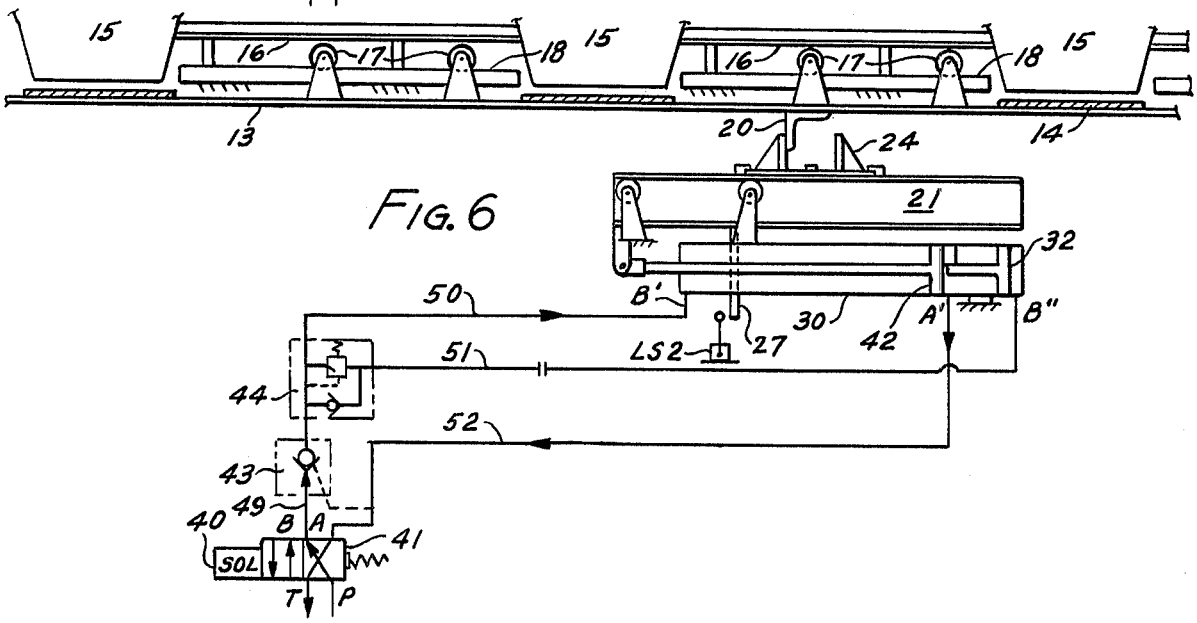
FIG. 6 is similar to FIG. 4 showing the apparatus with gates closed and apparatus in retracted position.

Referring to FIG. 6, when the flow of material from the storage bin 10 to the larry car 11 receiving hoppers 12 is completed the operator reverses the four-way valve 41 to initiate closing of the bin gates 14. Oil from the pump flows out of port B on the four-way valve 41 through line 49 thence through pilot operated check valve 43, sequence valve 44, and line 50 into hydraulic cylinder 30 at port B′. The hydraulic fluid forces piston 42 of the cylinder 30 to the right thereby also moving the carriage 21 to the right. Guiding element 24 mounted on carriage 21 after moving 6 inches contacts gate lever 20 and causes gates 14 to move 24 inches to the right and close after cylinder 30 completes a 30 inch stroke. While the gates 14 are closing by virtue of the movement of carriage 21, contact lever 27 mounted thereon contacts limit switch LS2 moving it back into its original position which stops the cycle. At this point the gates 14 are closed and the guiding element 24 is tight against the gate lever 20 projecting downwardly from bin gate frame 13.

Figure 7:
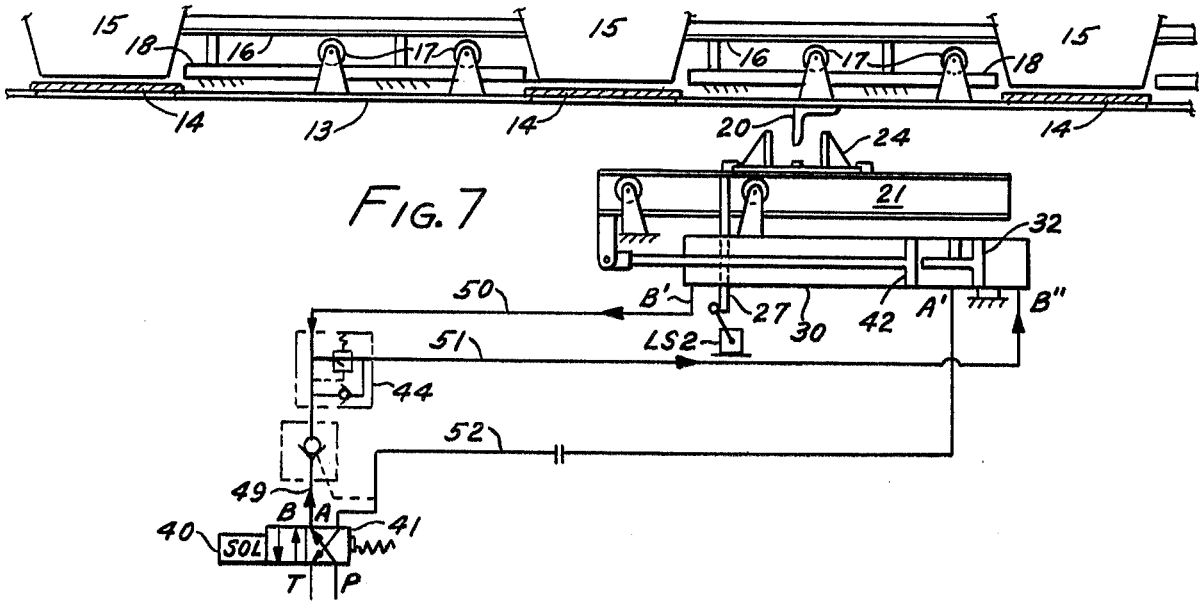
FIG. 7 is similar to FIG. 4 showing the apparatus returned to the car travel position.
Figure 8:
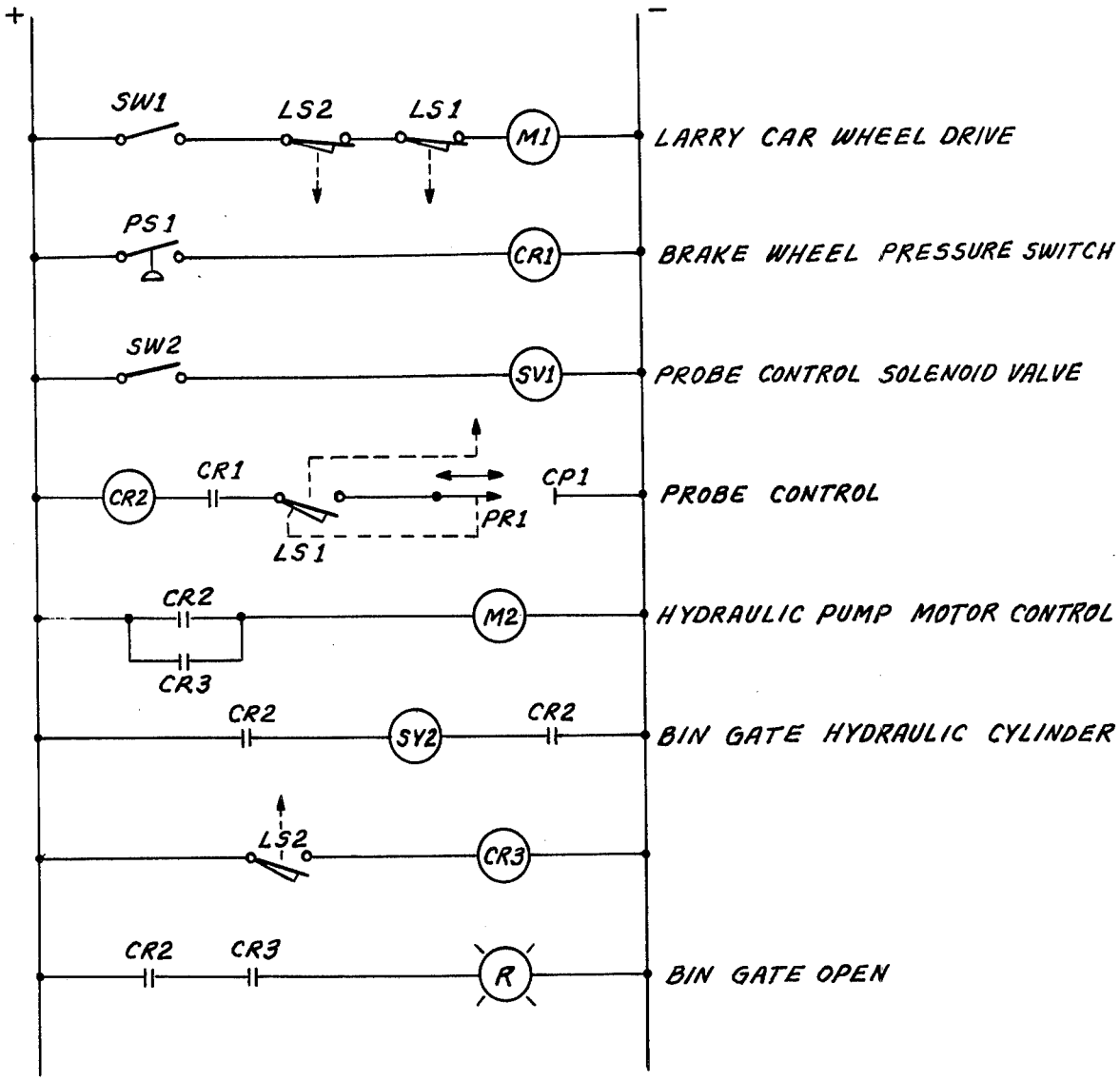
FIG. 8 is a schematic drawing of the electrical control circuit.

Referring now to FIG. 7 the reset cycle will be described in detail. When piston 42 completes its stroke to the right the hydraulic pressure rises in the system causing sequence valve 44 to shift so that hydraulic fluid flows through port B″. The hydraulic fluid flows from sequence valve 44 to cylinder port B″ causing piston 32 to move to the left. Fluid from the rod side of piston 42 goes out through port B′ down through sequence valve 44 and out through port B″ along with additional incoming oil to cylinder port B″. When piston 32 moves 3 inches to the left it causes carriage 21 to also move 3 inches to the left to allow travel clearance of 3 inches between the guiding element 24 and the gate lever 20.

A stop (not shown) within cylinder 30 limits the travel of piston 32.

At this position contact lever 27 contacts limit switch LS2 causing the electrical circuit to open stopping the hydraulic pump motor. It also closes the contact on the wheel drive motor lock-out control freeing the car for travel.

The apparatus described hereinabove provides unique means for opening and closing the bin gates of coal storage bins eliminating the prior art use of counterweights which requires additional operating power and installation costs. The gate closing is assured by the two-way limit switch which must be contacted on the return stroke of carriage 21 before the cycle is completed and the car is released to travel.

The apparatus is provided with positive means to lock the larry car in position, while maintaining power to the operator's cab for operating ventilating means and also assures against accidental drifting of the larry car from under the coal storage bins while coal is being discharged from the coal storage bins into the larry car hoppers. The use of the dual acting duplex hydraulic cylinder minimizes the amount of sequence controls that would otherwise be required to give the car traveling clearance.

I claim:

1. In apparatus for operating a bin gate on a material storage bin to control the flow of material stored therein into a material receiving hopper which is mounted in alignment with and beneath the material storage bin, the apparatus including a frame rigidly connected to the bin gate adapted for back and forth movement, a lever arm mounted on and projecting beneath the frame, a carriage mounted beneath and spaced from the frame, an upwardly projecting guiding element mounted on the carriage adapted to contact the downwardly projecting lever arm on the frame, the improvement comprising:

a double acting duplex hydraulic cylinder mounted on the material receiving hopper having first and second pistons moving freely of one another within the hydraulic cylinder and having rods extending in the same direction, the rod of the first piston attached to the carriage to move the carriage to open and close the bin gate when the first piston is actuated and the rod of the second piston, when the second piston is actuated, moves the first piston a distance to relocate the carriage and allow travel clearance between the guiding element and the lever arm.

2. In apparatus according to claim 1 the improvement further comprising:

means to lock the material receiving hopper in position beneath the material storage bin in alignment therewith.

3. In apparatus according to claim 1 the improvement further comprising:

safety means to prevent movement of the material receiving hopper from under the storage bin.

4. In apparatus according to claim 1 the improvement further comprising:

means to lock the material receiving hopper in position beneath the material storage bin in alignment therewith, and safety means to prevent movement of the material receiving hopper from under the storage bin.

* * * * *